US006643939B2

(12) United States Patent
Tajima et al.

(10) Patent No.: US 6,643,939 B2
(45) Date of Patent: Nov. 11, 2003

(54) CHAIN SAW WITH VIBRATION-ISOLATING DEVICES

(75) Inventors: Katsuya Tajima, Iruma (JP); Hisato Ohsawa, Tokyo (JP); Masato Nara, Tokyo (JP)

(73) Assignee: Kioritz Corporation, Tokyo (JP)

( * ) Notice: Subject to any disclaimer, the term of this patent is extended or adjusted under 35 U.S.C. 154(b) by 11 days.

(21) Appl. No.: 10/013,519

(22) Filed: Dec. 13, 2001

(65) Prior Publication Data

US 2002/0073558 A1 Jun. 20, 2002

(30) Foreign Application Priority Data

Dec. 15, 2000 (JP) ..... 2000-381841

(51) Int. Cl.[7] ..... B27B 17/02
(52) U.S. Cl. ..... 30/381; 173/162.2
(58) Field of Search ..... 30/381, 382, 383, 30/384, 385, 386; 173/162.1, 162.2

(56) References Cited

U.S. PATENT DOCUMENTS

| | | | | |
|---|---|---|---|---|
| 4,141,143 A | * | 2/1979 | Hirschkoff et al. | 30/381 |
| 4,202,096 A | * | 5/1980 | Nagashima | 30/381 |
| 4,324,045 A | * | 4/1982 | Hoppner et al. | 30/381 |
| 5,046,566 A | * | 9/1991 | Dorner et al. | 173/162.2 |
| 5,447,295 A | | 9/1995 | Taomo | |

FOREIGN PATENT DOCUMENTS

| | | |
|---|---|---|
| GB | 2 098 272 B | 8/1984 |
| JP | 63-21362 | 6/1988 |
| JP | 63-021362 | 6/1988 |
| JP | 2931025 | 5/1999 |
| JP | 2598703 | 6/1999 |

* cited by examiner

*Primary Examiner*—Hwei-Siu Payer
(74) *Attorney, Agent, or Firm*—Nixon Peabody LLP; Donald P. Studebaker

(57) ABSTRACT

A chain saw with vibration-isolating devices, capable of providing a desirable vibration-isolating effect over a wide frequency range and reducing accidental deviation from a desired cutting line in a cutting operation. The chain saw includes a main body containing an engine, a frame member mounting a grip handle thereon, and at least two vibration-isolating devices each interposed between the main body and the frame member to support the main body with respect to the frame member. Two of the vibration-isolating devices are disposed spaced apart from each other in the longitudinal direction of the chain saw. Each of the two vibration-isolating devises includes a pair of first and second vibration=isolating members which are different in frequency range for providing a vibration-isolating effect. The two vibration-isolating devices are disposed such that the respective first or second vibration-isolating members are positioned in a first or second diagonal relationship with respect to one another.

3 Claims, 5 Drawing Sheets

CHAIN SAW WITH VIBRATION-ISOLATING DEVICES

FIELD OF THE INVENTION

The present invention relates to a chain saw having vibration-isolating devices, capable of providing an improved vibration-isolating effect over a wide frequency range thereby reducing deviation from a desired cutting line.

BACKGROUND OF THE INVENTION

In Japanese Utility Model Publication No. Sho 63–21362, disclosed is a chain saw in which a main body with a two-stroke cycle internal combustion engine, a saw chain guide plate, etc. is mounted via an elastic member to a frame member having front and rear handles, etc.

Japanese Registered Utility Model Publication No. 2598703 also discloses a chain saw which has a mounting structure using a vibration-isolating coil spring for mounting a main body with a power source, such as an internal combustion engine, to a frame member with a grip handle, etc.

Further, Japanese Registered Patent Publication No. 2931025 discloses another chain saw wherein is adapted to make a significant difference between one side and the other side of a driving motor in terms of the sum of products derived from multiplying the spring stiffness values of vibration-isolating elements supporting the driving motor by the distances between each of the vibration-isolating elements and the center of a cylinder of the driving motor, so as to provide enhanced vibration-isolating effect.

However, the vibration-isolating mechanisms disclosed in the Japanese Utility Model Publication No. Sho 63–21362 and the Japanese Registered Utility Model Publication No. 2598703 suffer from an undesirable deviation from an intended cutting line in a sawing operation of an object to be cut (i.e. the object cannot be adequately cut along a straight line) due to inferior balance of the static stiffness between the vibration-isolating elements disposed in the chain saw. Furthermore, in these vibration-isolating mechanisms, respective vibration-isolating effects yielded from the vibration-isolating elements are effective only in the same frequency range, and it is thereby impossible to obtain a sufficient vibration-isolating effect over a wide frequency range. As a result, in a frequency range in which a sufficient vibration-isolating effect from the vibration-isolating mechanisms can not be obtained, undesirable vibration is transmitted to the front and rear handles substantially without receiving any damping effect.

On the other hand, the vibration-isolating mechanism disclosed in the Japanese Registered Patent Publication No. 2931025 has a significantly different static stiffness between the vibration-isolating elements arranged on the right and left sides of the driving motor. This causes undesirable deviation from an intended cutting line in a sawing operation using the chain saw. In addition, the vibration-isolating mechanism disclosed in the same Publication gives no consideration to the frequency range for each of the vibration-isolating elements to provide a vibration-isolating effect. Thus, this mechanism is also incapable of achieving a sufficient vibration-isolating effect over a wide frequency range.

SUMMARY OF THE INVENTION

It is therefore an object of the present invention to provide a chain saw with vibration-isolating devices, capable of providing an improved vibration-isolating effect over a wide frequency range thereby reducing deviation from a desired cutting line.

The above object can be achieved by way of a chain saw comprising: a main body; a prime mover arranged within the main body and having a driveshaft extending in a lateral direction of the chain saw; a saw chain extending from the main body in a forward direction of the chain saw; a frame member; a grip handle mounted on the frame member; and at least two vibration-isolating devices each interposed between the main body and the frame member to support the main body with respect to the frame member, two of the vibration-isolating devices are disposed at a space from each other in the forward direction, each of the two vibration-isolating devices including a pair of first and second vibration-isolating members which are different in frequency range in which a vibration-isolating effect is provided, the pair of first and second vibration-isolating members being disposed in series with and being spaced apart from each other in an axial direction of the driveshaft of the prime mover, and the two vibration-isolating devices are disposed such that the respective first vibration-isolating members are positioned in a first diagonal relationship and the respective second vibration-isolating members are positioned in a second diagonal relationship.

The present invention operates as follows. When a certain vibration is caused in the main body by driving the prime mover provided in the main body, the vibration energy is absorbed by the first and second vibration-isolating members. Thus, the vibration energy to be transmitted to the frame member is reduced. In addition, the first and second vibration-isolating members are different in frequency range for providing a vibration-isolating effect bringing about their respective vibration-isolating effects without interfering with each other.

Generally, a vibration-isolating member has a limited frequency range for providing a vibration-isolating effect. It is known, for example, that the vibration-isolating member employing a rubber material is typically effective in isolating vibration in a relatively low frequency, and the vibration-isolating member employing a spring is typically effective in isolating vibration in a relatively high frequency. However, a vibration-isolating device providing a desirable vibration-isolating effect over a wide frequency range is not achieved by simply combining two of the vibration-isolating members which are different in a frequency range for providing a vibration-isolating effect. The afore-mentioned object of the present invention is best achieved if different kinds of first and second vibration-isolating members are arranged substantially in series with each other and are combined in a balanced manner, such that the first and second vibration-isolating members are set up with their different frequency ranges for providing a vibration-isolating effect.

In addition, by arranging the paired first vibration-isolating members and the paired second vibration-isolating members respectively in first and second diagonal relationships, well-balanced supporting ability is provided on the right and left sides of the chain saw, and thereby accidental deviation from a desired cutting line will be reduced.

Preferably, the main body includes a guide-plate supporting portion for supporting a chain guide plate for guiding the saw chain, wherein one of the first and second vibration-isolating members having a lower static stiffness than that of the other of the first and second vibration-isolating members is disposed in the vicinity of the guide-plate supporting portion.

With this construction, the vibration-isolating member having a higher static stiffness is disposed at a position spaced apart from the guide-plate supporting portion. This makes it possible to generate a larger moment of force against the static force acting on the guide-plate supporting portion. Thus, the frame member can stably support the main body, and thereby accidental deviation from a desired cutting line will be further reduced.

Further, the above object can be achieved by A chain saw comprising: a main body; a prime mover having a driveshaft which extends in a lateral direction of the chain saw; a saw chain extending from the main body in the forward direction of the chain saw; a frame member; a grip handle mounted on the frame member; and at least four vibration-isolating devices, each interposed between the main body and the frame member to support the main body with respect to the frame member; the four vibration-isolating devices being formed in two pairs, each comprised of two of the vibration-isolating devices, the two pairs of vibration-isolating devices being disposed spaced apart from each other in the longitudinal direction of the chain saw, the two vibration-isolating devices making up each of the two pairs being disposed in series with and spaced apart from each other in the axial direction of the driveshaft of the prime mover, and each of the four vibration-isolating devices including first and second vibration-isolating members which are different in frequency range for providing a vibration-isolating effect, and are connected directly in series with each other.

Preferably, the first vibration-isolating member includes a coil spring, and the second vibration-isolating member includes a rubber component.

DETAILED DESCRIPTION OF THE PREFERRED EMBODIMENTS

A preferred embodiment of the present invention will now be described in detail with reference to the accompanying drawings.

Figure 1:
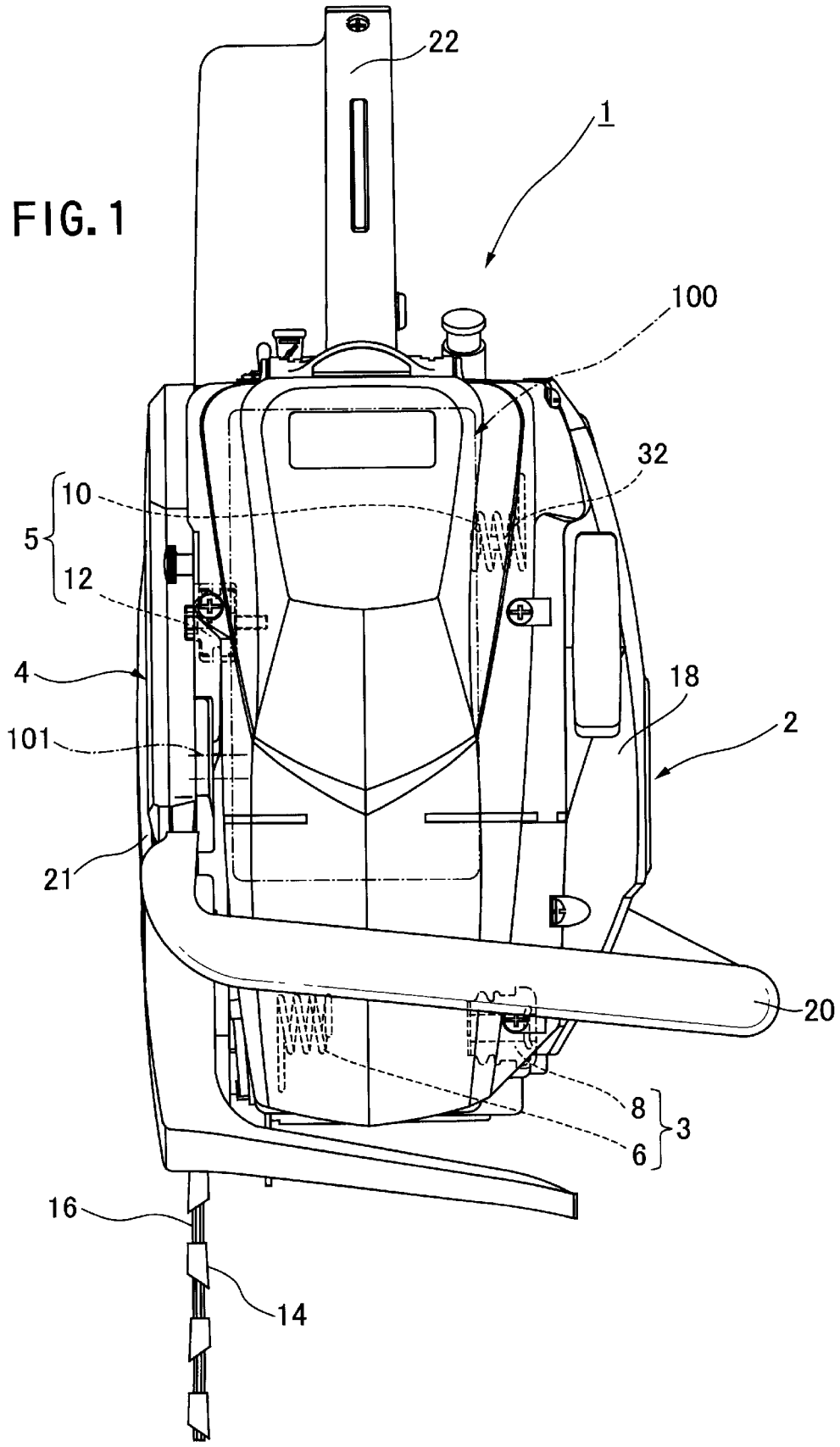
FIG. 1 is a plan view of a chain saw according to an embodiment of the present invention.
Figure 2:
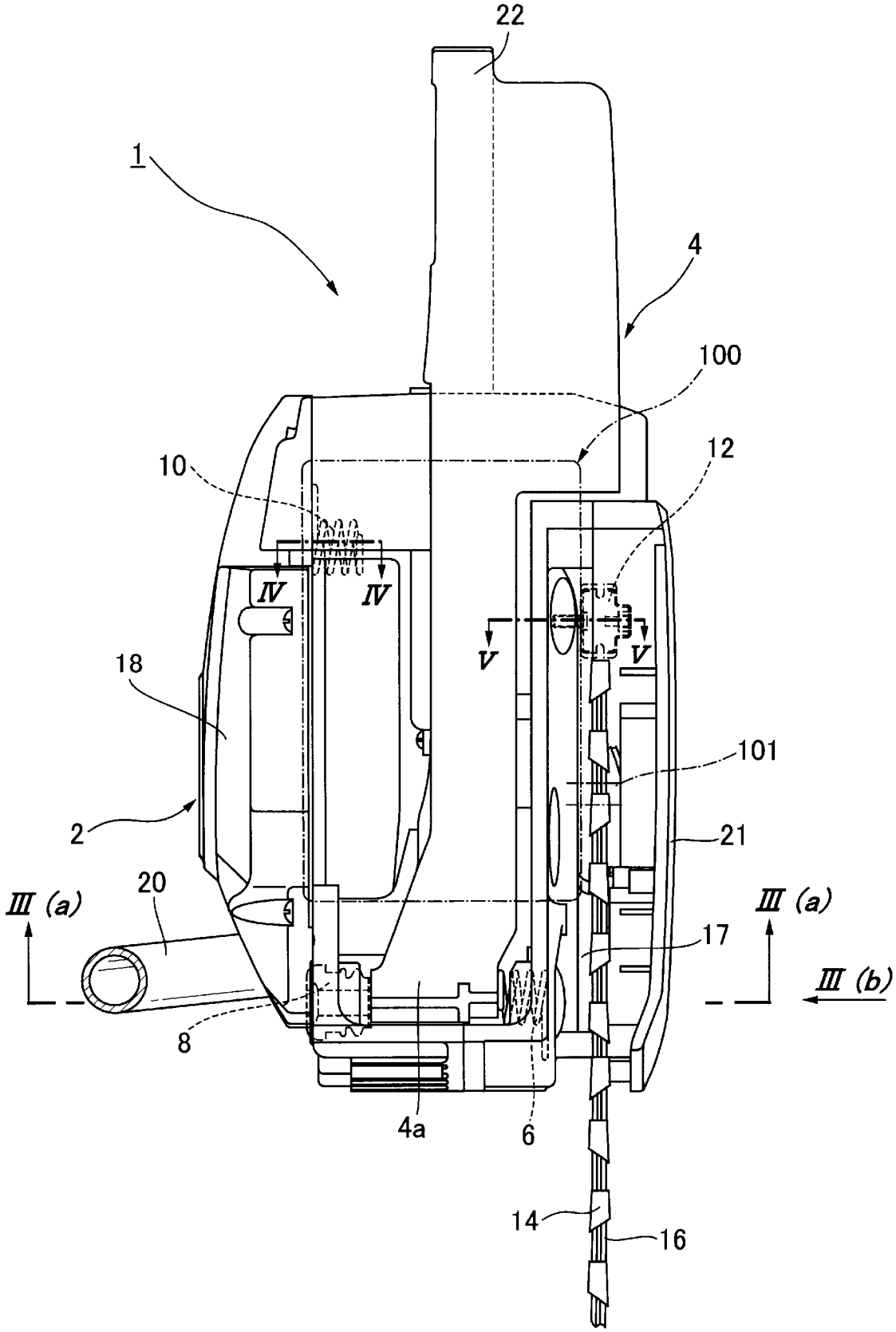
FIG. 2 is a bottom view of the chain saw according to the embodiment of the present invention.

As shown in FIGS. 1 and 2, the chain saw 1 according to the illustrated embodiment of the present invention comprises a main body 2, a frame member 4, a pair of front and rear vibration-isolating devices 3, 5, each of which are interposed between the main body 2 and the frame member 4. The front vibration-isolating device 3 includes a pair of right and left vibration-isolating members 6, 8 and the rear vibration-isolating device 5 includes a pair of right and left vibration-isolating members 10, 12. The main body 1 includes a prime mover or an internal combustion engine 100 such as an air-cooled two-stroke cycle internal combustion gasoline engine, a saw chain 14 driven by the internal combustion engine 100 in a well-known manner, a chain guide plate 16 extending in a longitudinal direction of the chain saw 1 and for guiding the saw chain 14, a guide plate supporting portion 17 for supporting the chain guide plate 16 and a side cover 21, and a main body cover 18 for covering the internal combustion engine 100. Grip handles or front and rear handles 20, 22, are mounted on the frame member 4. The internal combustion engine 100 is oriented so that the direction of the reciprocating motion of a piston (not shown) of the internal combustion engine 100 aligns with the vertical direction of the chain saw 1. Thus, a drive shaft (output shaft) of the internal combustion engine 100 or crankshaft 101 extends in a right/left or lateral direction of the chain saw 1.

Figure 3A:
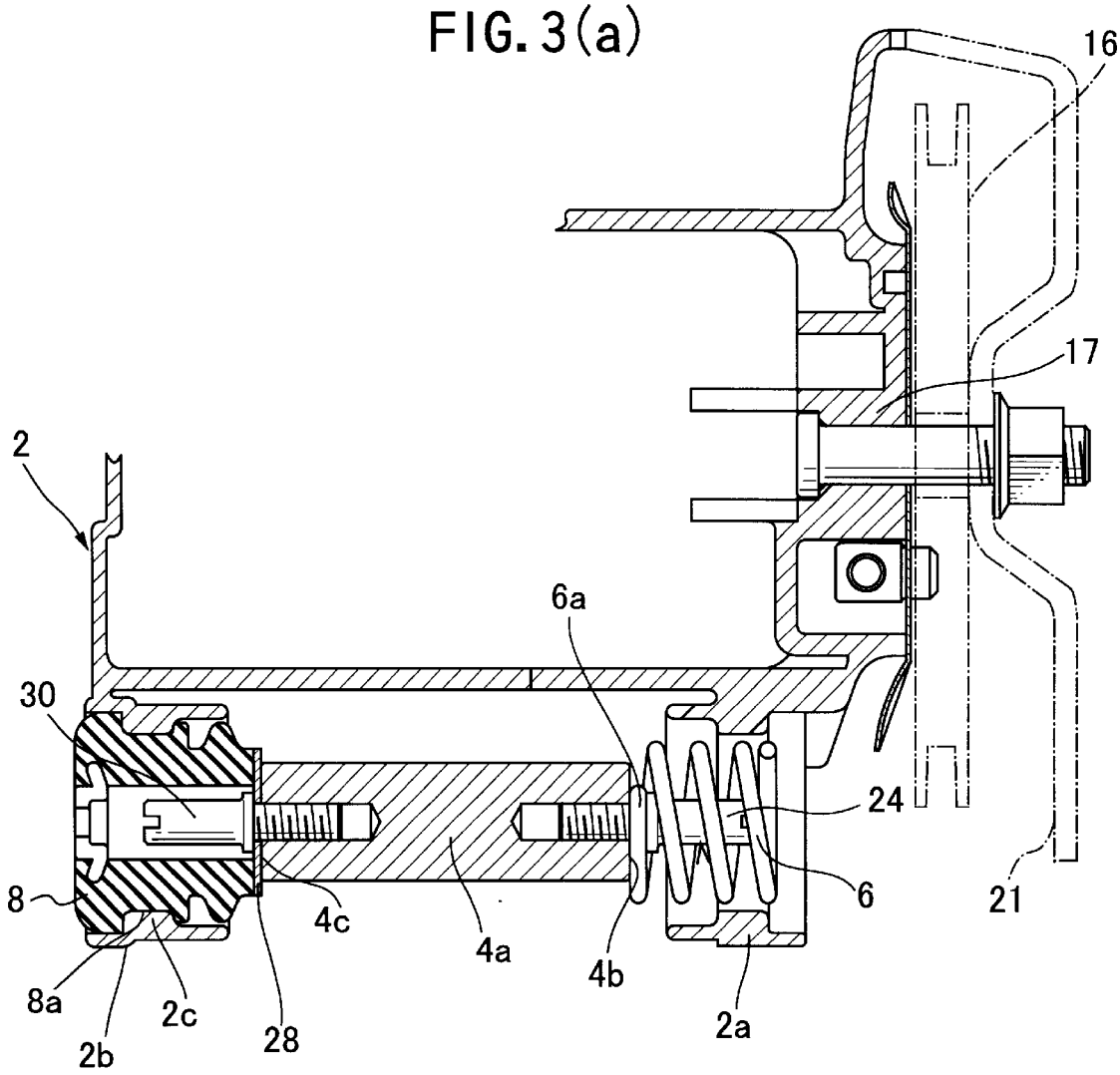
FIG. 3 shows the structure of a vibration-isolating device disposed on the front side of the chain saw according to the embodiment of the present invention, wherein FIG. 3(*a*) is a partial sectional view taken along a line III(*a*)-III(*a*) of FIG. 2, and FIG. 3(*b*) is a partial view seen in the direction shown by the arrow III(*b*) of FIG. 2.
Figure 3B:
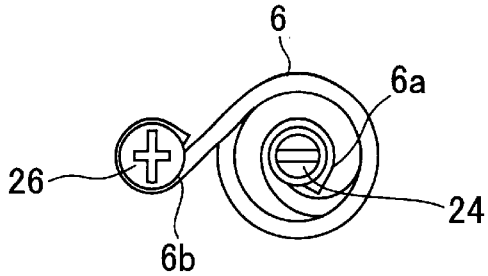

Now, referring to FIG. 3, the front vibration-isolating device 3 comprised of the front right and front left vibration-isolating members 6, 8 which are disposed on the front side of the chain saw 1 will be described. As shown in FIG. 3(*a*), a substantially cylindrical mounting portion 2*a* for the front right vibration-isolating member 6 is formed on the bottom side of the main body 2 with an axis of the cylinder directed laterally. The front right vibration-isolating member 6 which is a coil spring made of a spring-steel is mounted on the frame member 4 within the front right vibration-isolating member mounting portion 2*a* with the axis of the front right vibration-isolating member directed laterally. Specifically, one end 6*a* of the vibration-isolating member 6 is fixedly mounted on a right end face 4*b* of a bottom front end 4*a* of the frame member 4 with a setscrew 24. As shown in FIG. 3(*b*), the other end 6*b* of the vibration-isolating member 6 is mounted on the main body 2 with a setscrew 26.

On the other hand, a front left vibration-isolating member mounting portion 2*b* is coupled with the bottom-and-front end portion 4*a* at the opposite side of the front right vibration-isolating member 6 through the front left vibration-isolating member 8 made of synthetic rubber. The front left vibration-isolating member 8 has a substantially cylindrical shape, and a groove 8*a* is formed around the outer periphery thereof. The front left vibration-isolating member 8 also has an inner end surface to which a washer 28 is attached. The front left vibration-isolating member mounting portion 2*b* is formed in a substantially cylindrical shape with its axis directed laterally, and a protrusion 2*c* is formed around the inner periphery of the cylinder. When the front left vibration-isolating member 8 is pushed into the substantially cylindrical front left vibration-isolating member mounting portion 2*b*, the protrusion 2*c* formed around the inner periphery of the front left vibration-isolating member mounting portion 2*b* is received into and engaged with the groove 8*a* so as to fix the front left vibration-isolating member 8 to the main body 2. Further, the front left vibration-isolating member 8 is fixed to the bottom front end 4*a* by fixing the washer 28 attached to the front left vibration-isolating member 8 to the left end face 4*c* of the bottom front end 4*a* with a setscrew 30.

The front left vibration-isolating member 8, made of synthetic rubber which provides a sufficient vibration-isolating effect in a low frequency range, is designed to have a static stiffness, i.e. a stiffness against a force statically applied thereon, higher than that of the front right vibration-isolating member 6 which is a coil spring providing a sufficient vibration-isolating effect in a high frequency range.

Figure 4:
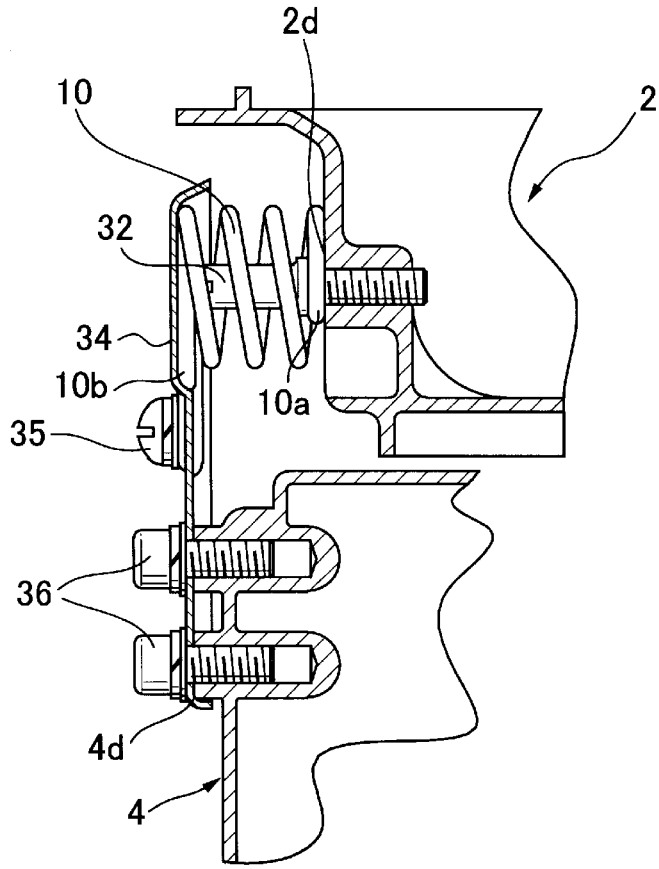
FIG. 4 is a partial sectional view take along a line IV—IV of FIG. 2 showing the structure of one of vibration-isolating members of a vibration-isolating device disposed on the rear side of the chain saw according to the embodiment of the present invention.
Figure 5:
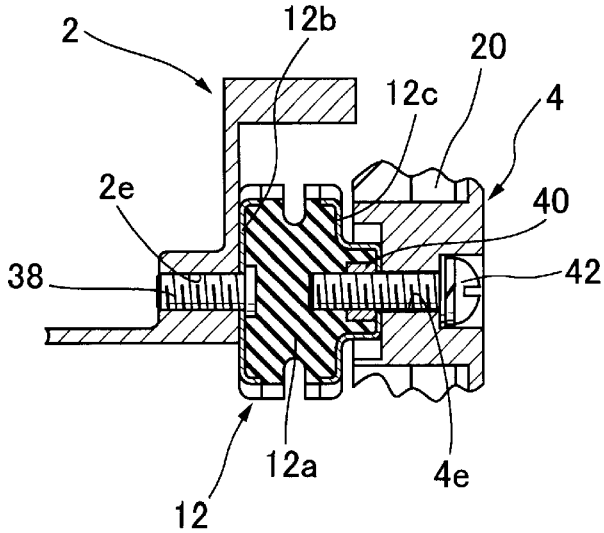
FIG. 5 is a partial sectional view showing taken along a line V—V of FIG. 2 the structure of the other vibration-isolating of the vibration-isolating device member disposed on the rear side of the chain saw according to the embodiment of the present invention.

Now, referring to FIGS. 4 and 5, the rear vibration-isolating device 5 composed of the rear right and rear left vibration-isolating members 10, 12 and disposed on the rear lower side of the chain saw 1 will be described. As shown in FIG. 4, the main body 2 is supported by the frame member 4 on the rear side of the chain saw 1 via the rear left vibration-isolating member 10 which is a coil spring. The one end 10*a* of the rear left vibration-isolating member 10 is fixed to the rear left lower receiving face 2*d* of the main body 2 with a setscrew 32. Further, a holding plate 34 is fixed to a plate mounting portion 4*d* of the frame member 4 with two bolts 36 and whereby the outer end side of the rear left vibration-isolating member 10 is held by the holding plate 34. The other end 10*b* of the rear left vibration-isolating member 10 is fixed to the holding plate 34 with a setscrew 35.

On the other hand, the rear right vibration-isolating member 12 made of rubber is mounted with its axis directed laterally on the right mounting base portion for the front handle 20 which makes up a part of the frame member 4 located on the rear lower side of the chain saw 1 and on the opposite side of the rear left vibration-isolating member 10. As shown in FIG. 5, the rear right vibration-isolating member 12 includes a substantially cylindrical rubber body 12*a* having a groove formed around the outer periphery thereof, and thin plates 12*b*, 12*c* attached to both end faces of the rubber body 12*a*, respectively. The thin plate 12*b* on the side of the main body 2 is of a pie-plate shape, and the thin plate 12*c* on the side of the front handle 20 is of a pie-plate shape including a concentric concave portion. These thin plates 12*b*, 12*c* are oriented so that their openings face toward each other, and the rubber body 12*a* is received and bonded therebetween. A screw 38 is attached to the main body-side thin plate 12*b* to allow the top portion of the screw 38 to be protruded laterally outward from a hole formed in the center of the thin plate 12*b*. A nut 40 is attached to the front handle side of the thin plate 12*c*.

Preferably, a suitable type of vibration-isolating member may be interposed between the right upper portion of the frame member 4 and the right upper portion of the front handle 20 if needed.

The rear right vibration-isolating member 12 is mounted on the main body 2 by driving the screw 38 protruding laterally from the main body-side thin plate 12*b* into a female screw 2*e* formed in the main body 2. The rear right vibration-isolating member 12 is also fixed to the frame member 4 by driving a setscrew 42 into the nut 40 through a hole 4*e* formed in the frame member 4 (the right mounting base for the front handle 20). In this manner, the main body 2 and the frame member 4 are coupled with each other through the vibration-isolating member 12.

The rear right vibration-isolating member 12 which provides a sufficient vibration-isolating effect in a low frequency range is designed to have a higher static stiffness than that of the rear left vibration-isolating member 10 which provides a sufficient vibration-isolating effect in a high frequency range.

The operation of the chain saw 1 according to the embodiment of the present invention will be described below. To use the chain saw 1, the internal combustion engine 100 provided in the main body 2 is started up. Once the internal combustion engine 100 is started, the reciprocating motion of the piston (not shown) causes a vibrational force acting on the main body 2 through the crankshaft 101. This vibration force acts mainly in the direction of the reciprocating motion of the piston (not shown), i.e. in the vertical direction of the chain saw 1. When cutting an object to be cut with the chain saw 1, a reaction force from the object acts on the saw chain 14 and the chain guide plate 16, and further vibrates the main body 2.

However, since the main body 2 is supported by the frame member 4 through the four vibration-isolating members 6, 8, 10, 12, the vibrational energy transmitted from the main body 2 to the frame member 4 is absorbed by the four vibration-isolating members 6, 8, 10, 12. Further, each of the vibration-isolating members 8, 12 made of rubber has a larger spring constant in the axial direction thereof and a smaller spring constant in the direction perpendicular to the axis. Thus, the vibration in the vertical direction of the chain saw 1 otherwise applied with a large vibrational force is isolated to prevent the chain saw 1 from being vibrated. In addition, the vibration-isolating device 3 disposed on the front side of the chain saw 1 and the vibration-isolating device 5 disposed on the rear side of the chain saw 1 are formed in a substantially serial arrangement (or coaxial arrangement) of a coil spring and a rubber element. Thus, the vibration in a low frequency range is absorbed mainly by the rubber elements and the vibration in a high frequency range is absorbed mainly by the coil spring.

In this embodiment, the vibration-isolating members 6, 8, 10, 12 of the same kind are disposed in a diagonal relationship. Further, the vibration-isolating member 6 which is a coil spring is disposed close to the guide-plate supporting portion 17 of the chain saw 1, and the vibration-isolating members 8, 12 made of rubber are disposed at two positions spaced apart from the guide-plate supporting portion 17, respectively. With this arrangement, each of the vibration-isolating members 8, 12 made of rubber having a higher static stiffness than that of the coil spring act a large moment of force on the guide-plate supporting portion 17 to prevent the deviation from a desired cutting line.

In this embodiment, the frequency range in which vibration insulation is needed is divided into two ranges. The coil-spring vibration-isolating members 6, 10 and the rubber vibration-isolating members 8, 12 having their different properties each effectively functions in each of the divided ranges. This makes it possible to provide effective vibration insulation to both low-frequency vibration and high-frequency vibration caused in high-speed operation and low-speed operation of the internal combustion engine 100, respectively.

Additionally, dividing the frequency range in which the vibration insulation is needed allows the vibration-isolating members 8, 12 to be formed of a stronger rubber having a higher hardness. This prevents undesirable breakage of the rubber element or the like.

Further, since the same type of the vibration-isolating members 6, 10 composed of coil springs and the vibration-isolating members 8, 12 made of rubber are disposed in a diagonal relationship, the main body 2 is supported at both the right and left sides of the chain saw 1 in a balanced manner by the frame member 4. Thus, in cutting operation, accidental deviation from a desired cutting line is reduced. In this embodiment, the chain guide plate 16 mounted on the guide-plate supporting portion 17 can also be rigidly supported to provide further reduced deviation.

Figure 6:
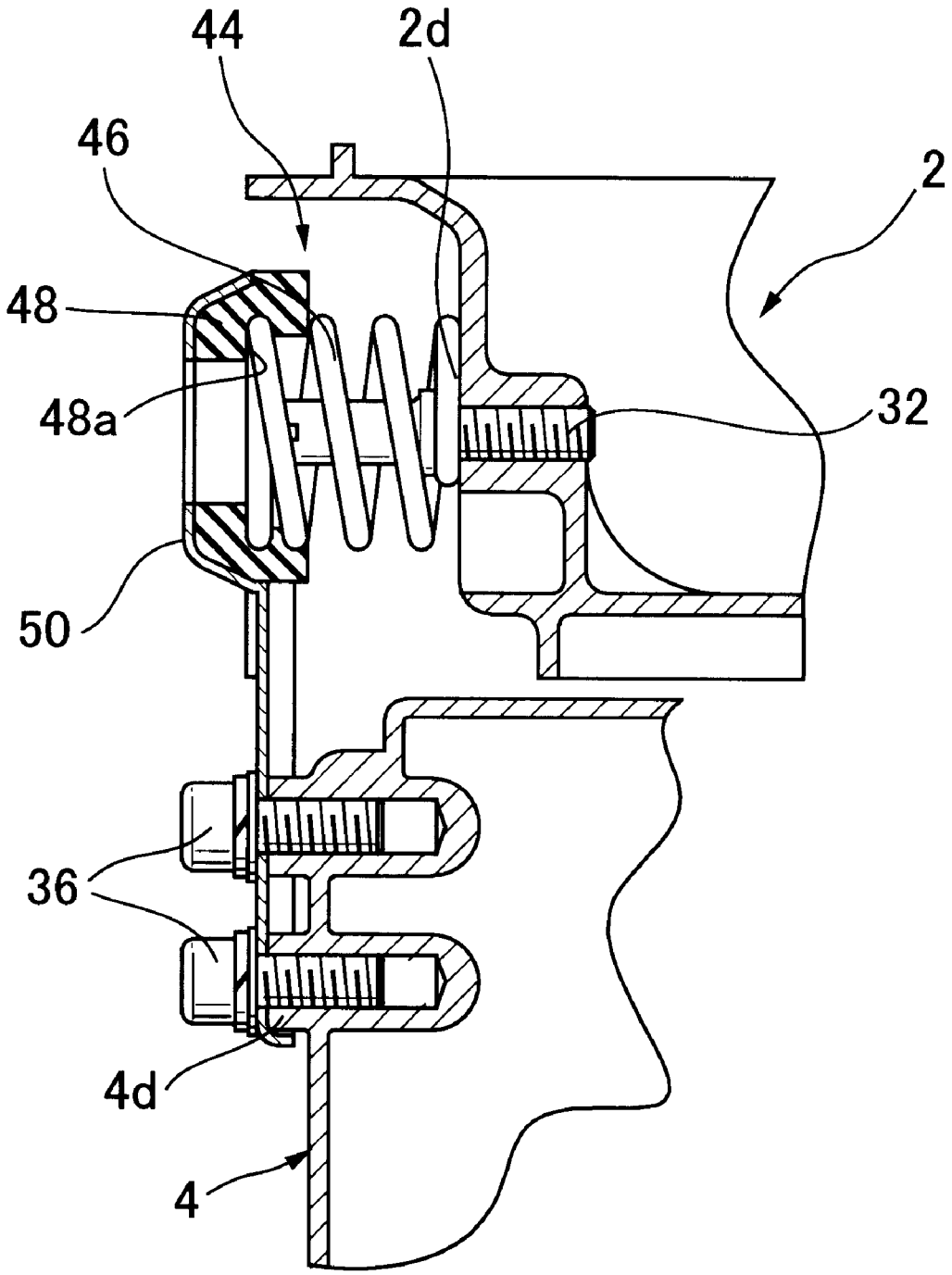
FIG. 6 is a partial sectional view showing a modification of the vibration-isolating member shown in FIG. 4.

With reference to FIG. 6, another embodiment of the present invention will be described as a modification.

The vibration-isolating device 44 comprises a vibration-isolating member 46 which is a coil spring and a vibration-isolating member 48 which is made of rubber. The rubber vibration-isolating member 48 has an annular configuration, and a step portion 48*a* is formed around the inner periphery thereof. The coil-spring vibration-isolating member 46 is attached integrally to the rubber vibration-isolating member 48 by pushing the coil-spring vibration-isolating member 46 into the rubber vibration-isolating member 48 until the coil-spring vibration-isolating member 46 contacts the step portion 48*a*. The coil-spring vibration-isolating member 46 is fixed to the receiving face 2*d* of the main body 2 with the setscrew 32. A holding plate 50 has an inner surface on which the vibration-isolating member 48 is bonded. The holding plate 50 is fixed to the plate mounting portion 4*d* of the frame member 4 with two bolts 36 so as to press against the outer end portion of the coil-spring vibration-isolating member 46. In this manner, the main body 2 is supported by the frame member 4 through the vibration-isolating device 44.

Similarly, all of the vibration-isolating members 6, 8, 10, 12 as shown in FIGS. 1 and 2 may be substituted with the vibration-isolating devices 44. This construction provides improved assembly performance and reduced variation in the vibration-isolating effect due to variances caused in the assembling processes.

As in the vibration-isolating device 44, when the paired vibration-isolating members 46, 48 which are different in frequency range providing a vibration-isolating effect are coupled directly in series with each other, the manner of transmitting force is changed as compared with the foregoing embodiment in which the coil-spring vibration-isolating member 6, 10 and the rubber vibration-isolating member 8, 12 are disposed on both sides of the main body 2, respectively. That is, the force transmitted from the main body 2 to the coil-spring vibration-isolating member 46 is transmitted to the frame member 4 through the rubber vibration-isolating member 48. This construction can also provide a desirable vibration-isolating effect over a wide frequency range. Further, in the construction in which the main body 2 is supported by four vibration-isolating devices each having a similar structure to the vibration-isolating device 44, each supporting force on the right and left sides of the main body 2 is supported is adequately balanced, and thereby undesirable deviation from a desired cutting line is reduced.

While a coil spring and rubber are used as the vibration-isolating members in the embodiment shown in FIGS. 1 to 5 and the modification shown in FIG. 6, any suitable component or material, such as a leaf spring, torsion bar, or urethane foam, may be used depending on desired applications. Further, the vibration-isolating devices need not necessarily be comprised of the pair of the coil-spring vibration-isolating member and the rubber vibration-isolating member, and may be composed of any suitable vibration-isolating devices which are different in frequency range for providing a vibration-isolating effect, for example, a pair of coil springs or a pair of rubber elements.

The two vibration-isolating devices 3, 5 are provided in the chain saw 1 shown in FIGS. 1 to 5, and the four vibration-isolating devices 44 are provided in the chain saw 1 shown in FIG. 6. However, as long as these vibration-isolating devices are disposed to keep the supporting forces for supporting the main body 2 by the frame member 4 in a balanced manner longitudinally and laterally, more than two vibration-isolating devices 3, 5 or more than four of the vibration-isolating devices 44 may be provided.

While the chain saw 1 shown in FIG. 6 is provided with four vibration-isolating devices 44, only two of the four vibration-isolating devices 44 may, for example, be left in the vibration-isolating devices, and other two may be substituted with the vibration-isolating devices 3, 5, as long as these vibration-isolating devices are disposed to keep the supporting force in a balanced manner longitudinally and laterally.

Further, the prime mover may be an electric motor.

Thus, the present invention can provide an improved chain saw with vibration-isolating devices, capable of providing a desirable vibration-isolating effect over a wide frequency range and reducing accidental deviation from a desired cutting line in cutting operation.

While the present invention has been described in conjunction with preferred embodiments, various changes and modifications can be made to the disclosed embodiments within the subject matter described in the appended claims, without departing from the spirit or scope of the present invention.

What is claimed is:

1. A chain saw comprising:

a main body;

a prime mover arranged within said main body and having a driveshaft extending in a lateral direction of said chain saw;

a saw chain extending from said main body in a forward direction of said chain saw;

a frame member;

a grip handle mounted on said frame member; and at least two vibration-isolating devices each interposed between said main body and said frame member to support said main body on said frame member, two of said vibration-isolating devices are disposed at a space from each other in said forward direction, each of said two vibration-isolating devices including a pair of first and second vibration-isolating members, each of said first and second vibration-isolating members have a different frequency range in which a vibration-isolating effect is provided, said pair of first and second vibration-isolating members being disposed in series with and spaced apart from each other in an axial direction of said driveshaft of said prime mover, and said two vibration-isolating devices are positioned such that said respective first vibration-isolating members are in a first diagonal relationship with one another and said respective second vibration-isolating members are in a second diagonal relationship with one another.

2. A chain saw as recited in claim 1, wherein said main body includes a guide-plate supporting portion for supporting a chain guide plate for guiding said saw chain, and one of said first and second vibration-isolating members having a lower static stiffness than that of the other of said first and second vibration-isolating members is disposed in a vicinity of said guide-plate supporting portion.

3. A chain saw as recited in claim 1, wherein said first vibration-isolating member includes a coil spring, and said second vibration-isolating member includes a rubber component.

* * * * *